US005564961A

United States Patent [19]

Spector

[11] Patent Number: 5,564,961

[45] Date of Patent: Oct. 15, 1996

[54] WATER-PISTOL AND PUPPET ASSEMBLY

[76] Inventor: Donald Spector, 380 Mountain Rd., Union City, N.J. 07080

[21] Appl. No.: 431,834

[22] Filed: May 1, 1995

[51] Int. Cl.[6] ..... A63H 3/00; A63H 33/30

[52] U.S. Cl. ..... 446/72; 446/74; 446/475; 222/78; 222/79; 239/211; 239/154; 472/52

[58] Field of Search ..... 472/51, 52; 446/72, 446/74, 475, 473, 483, 267, 268, 327, 369; 222/78, 79; 239/211, 154

[56] References Cited

U.S. PATENT DOCUMENTS

| | | | |
|---|---|---|---|
| 1,462,041 | 7/1923 | Meyer | 239/211 |
| 1,660,085 | 2/1928 | Nassau | 239/211 X |
| 2,538,123 | 1/1951 | Price | 446/74 |
| 3,299,891 | 1/1967 | Smeton | 222/78 X |
| 4,353,139 | 10/1982 | Wainwright et al. | 239/211 X |
| 4,821,960 | 4/1989 | Goldman | 239/211 |
| 4,864,333 | 9/1989 | Barber | 446/72 X |
| 5,172,863 | 12/1992 | Melone et al. | 446/475 X |
| 5,297,980 | 3/1994 | Barthold | 222/78 X |

*Primary Examiner*—Robert A. Hafer
*Assistant Examiner*—D. Neal Muir
*Attorney, Agent, or Firm*—Michael Ebert

[57] ABSTRACT

A water-pistol and puppet assembly in which the pistol is concealed within the puppet, yet is fully operable. The pistol includes a hand grip provided with a trigger, a liquid reservoir and a pump which when the trigger is pulled then draws liquid from the reservoir and pumps it into the barrel of the pistol from whose outlet nozzle the liquid is ejected. The puppet includes a head having an open mouth that simulates that of a human or animal-like figure and a costume shroud simulating the body of the figure associated with the head. The shroud is provided with open top end defining a neck that is attached to the head and an open bottom end affording access to the interior of the shroud in which the pistol is housed. The barrel of the pistol is socketed in the head of the puppet with its outlet nozzle in alignment with the open mouth. When a player extends his hand through the open bottom end of the shroud to grasp the grip of the pistol, he then appears to be holding the puppet. And when the player pulls the trigger to cause liquid to be ejected from the outlet nozzle, the puppet then appears to be spitting out this liquid.

7 Claims, 2 Drawing Sheets

WATER-PISTOL AND PUPPET ASSEMBLY

BACKGROUND OF INVENTION

1. Field of Invention

This invention relates generally to water-pistols and more particularly to a water-pistol and puppet assembly which when a player grasps the grip of the pistol housed within the puppet, he then appears to be holding the puppet, and when he operates the pistol to eject liquid therefrom, the puppet then appears to be spitting out this liquid.

2. Status of Prior Art

A puppet is a figure usually of small size having a human or animal-like form that is manipulated by the hand of the player holding the puppet. A distinction is made between a marionette that is manipulated by strings or wires from above and a hand puppet in which the hand of the player is concealed in the costume of the puppet which simulates the body attached to the head of the figure.

The typical hand puppet has a hollow head and a costume provided with hollow arm and leg extensions, so that when the fingers of the hand holding the puppet are inserted into the head and the arm and leg extensions, these may be manipulated to activate the puppet. And the player manipulating the puppet is often a ventriloquist who speaks or sings in a voice imitating the voice of the character represented by the puppet.

Puppet shows, such as Punch and Judy, have long been popular. And on television, one often sees puppet shows such as those performed by the group of puppets created by Jim Henson, known as the muppets. Puppets representing various characters are available in most toy stores, for children take delight in playing with puppets.

A water-pistol has nothing at all to do with a puppet other than the fact that a water-pistol, like a puppet, is hand operated. All water-pistols, regardless of their internal mechanism, include a hand grip provided with a trigger which when pulled then draws liquid from a liquid reservoir and pumps the liquid into the barrel of the pistol from whose outlet nozzle the liquid is ejected.

In recent years, the trend in water-pistol design has been toward creating realistic replicas of military or police small arms. This made it possible for children playing with these water-pistols to imitate a cops and robbers gun fight or actual military combat.

Most toys which children enjoy seek to emulate adult activity. Thus a child playing with a toy automobile prefers that this toy vehicle closely resemble a model of a Cadillac or other well-known auto.

But water-pistols which resemble real weapons are now in public disfavor and in some states they are banned. The reason for the interdiction of water-pistols which are replicas of real weapons is that crime is now rampant in the streets of most American cities and even in many suburbs.

Police under stress may be unable to distinguish between a real gun and a water-pistol that is a replica of this gun. As a consequence of this confusion, there are instances where a police officer has shot a child pointing a water-pistol at him, thinking it was a real gun.

Yet water-pistols are essentially innocuous and it is unfair to deprive children of the joys of playing with these pistols. On the other hand, an exposed water-pistol is no longer acceptable to the public.

Of prior art background interest is the patent 3,578,789 to Ferri showing a water pistol having a trigger-actuated pump for withdrawing liquid from a reservoir and supplying it to the nozzle of the gun. Also of prior art interest are the Altsheler U.S. Pat. No. 3,038,483 which discloses a water pistol combined with an umbrella, the Pottick U.S. Pat. No. 5,071,387 which discloses a figurine-shaped toy that squirts water out of its mouth by cranking an arm, and the Greene U.S. Pat. No. 3,420,412 in which a pressurized spray can is enclosed in a hollow body simulating an animal in shape.

SUMMARY OF INVENTION

In view of the foregoing, the main object of this invention is to provide an operating water-pistol that is disguised as a puppet so that one who sees the puppet has no idea of its true function, yet the child who plays with the concealed pistol can shoot water therefrom.

More particularly, an object of this invention is to provide a water-pistol and puppet assembly in which the player appears to be manipulating a puppet, but when the player pulls the trigger of the pistol concealed within the puppet, then liquid is squirted from the open mouth of the puppet who appears to be spitting.

A significant advantage of an assembly in accordance with the invention is that it may include a standard water-pistol of any design, even one that is a replica of a real weapon, for the water-pistol is completely concealed by the puppet and its appearance is never visible when the puppet is being held in the hand of a player.

Briefly stated, these objects are attained by a water-pistol and puppet assembly in which the pistol is concealed within the puppet, yet is fully operable. The pistol includes a hand grip provided with a trigger, a liquid reservoir and a pump which when the trigger is pulled then draws liquid from the reservoir and pumps it into the barrel of the pistol from whose outlet nozzle the liquid is ejected. The puppet includes a head having an open mouth that simulates that of a human or animal-like figure and a costume shroud simulating the body of the figure associated with the head.

The shroud has an open top end defining a neck that is attached to the head and an open bottom end affording access to the interior of the shroud in which the pistol is housed. The barrel of the pistol is socketed in the head of the puppet with its outlet nozzle in alignment with the open mouth. When a player extends his hand through the open bottom end of the shroud to grasp the grip of the pistol, he then appears to be holding the puppet. And when the player pulls the trigger to cause liquid to be ejected from the outlet nozzle, the puppet then appears to be spitting out this liquid.

BRIEF DESCRIPTION OF DRAWINGS

For a better understanding of the invention, as well as further features thereof, reference is made to the detailed description thereof to be read in connection with the annexed drawings wherein.

DESCRIPTION OF INVENTION

Figure 1:
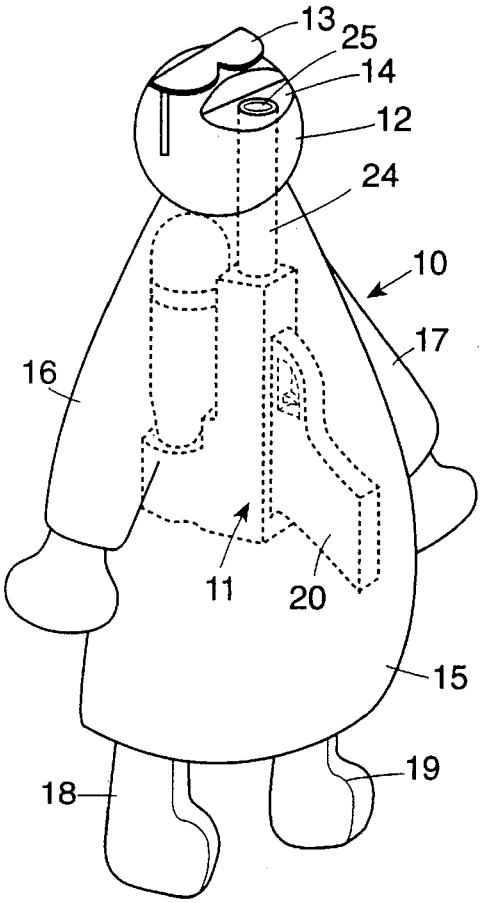
FIG. 1 is a perspective view of a water-pistol and puppet assembly in accordance with the invention, the puppet having a human-like head.

FIGS. 1 to 4 illustrate a water-pistol and puppet assembly in accordance with one preferred embodiment of the invention. The puppet is generally designated by reference numeral 10 and the pistol by reference numeral 11.

Puppet 10 includes a globular humanoid head 12 molded or otherwise formed of foam plastic or similar solid material. Head 12 is provided with a pair of simulated sun glasses 13 that overlie the eyes of the head and an open mouth 14.

Attached to the base of the head 12 is a neck defined by the open top end of a shroud 15 which is fabricated of fabric or plastic film material that is appropriately decorated to create the costume of the puppet. The open bottom end of the shroud is also open, as in a conventional puppet, so that a player can freely insert his hand into the interior of the shroud.

Shroud 15 includes a pair of arm extensions 16 and 17 terminating in stuffed hands. Attached to opposite sides of the open bottom end of the shroud are leg extensions 18 and 19 terminating in stuffed feet. Thus the shroud simulates the body of the humanoid figure.

Figure 2:
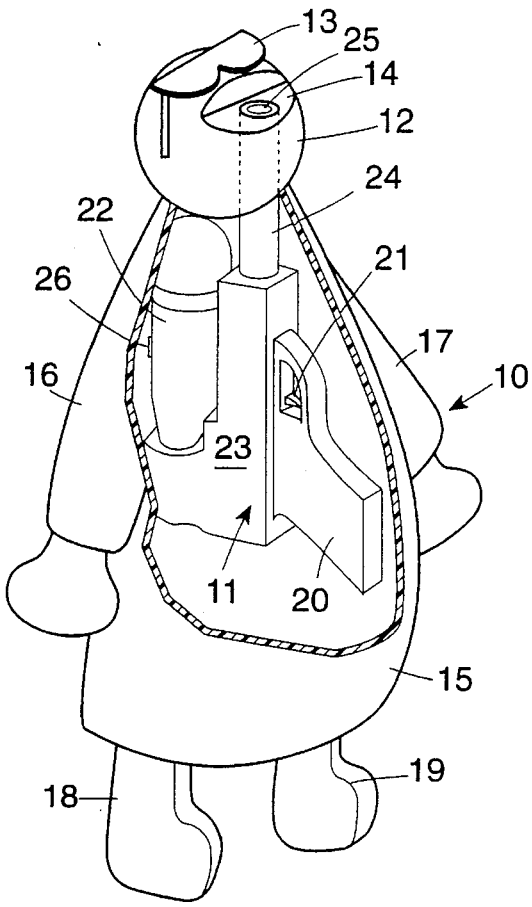
FIG. 2 is a cut away view exposing the water-pistol concealed within the puppet.

As best seen in FIG. 2, housed within shroud 15 and concealed thereby is water-pistol 11. Pistol 11 includes a hand grip 20 having a trigger 21, a miniature water tank or reservoir 22 mounted above a pump 23, and a barrel 24 projecting axially from the front end of the pump. The barrel at its leading end has an outlet nozzle 25. Reservoir 22 is provided with a removable plug 26 so that it may be refilled with water or other liquid, such as milk or juice.

Figure 3:
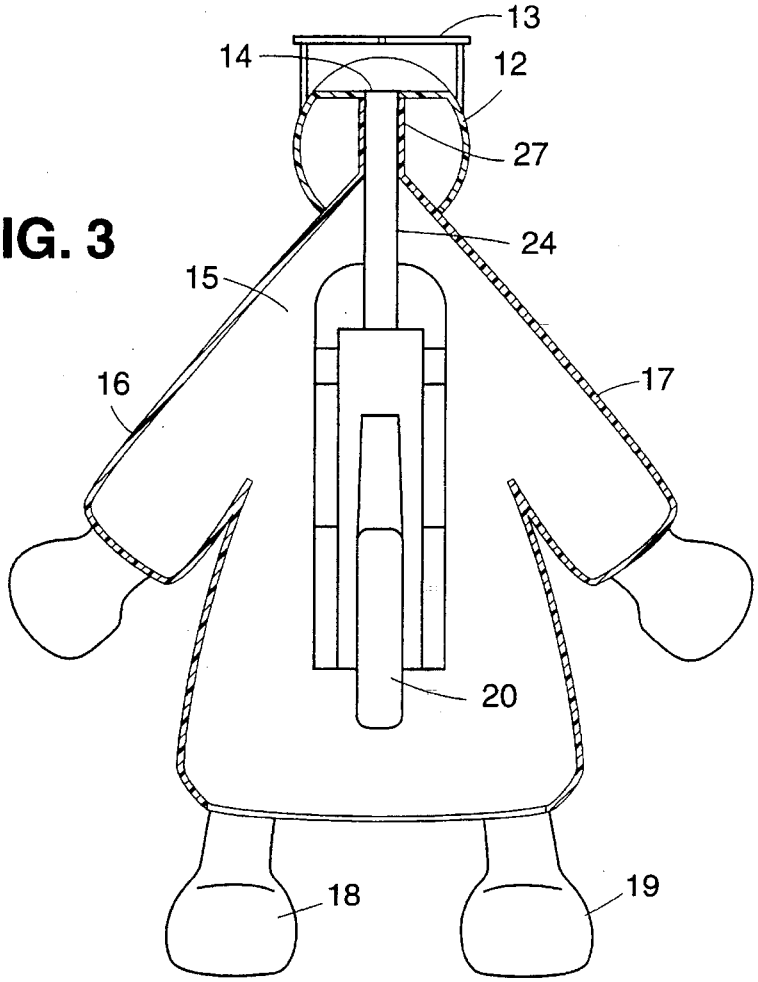
FIG. 3 is a section taken through the head of the puppet showing how the barrel of the pistol is socketed therein.

As best seen in FIG. 3 head 12 of the puppet has an internal cavity lined by a cylindrical sleeve 27 adapted to securely socket the leading end of the water-pistol. In practice, the barrel may be bonded to the sleeve. Sleeve 27 is positioned in registration with the open mouth 14 of the puppet. Hence outlet nozzle 25 of the barrel is in alignment with the mouth, and water ejected from the nozzle passes through the open mouth to spray any one in the vicinity of the puppet.

Figure 4:
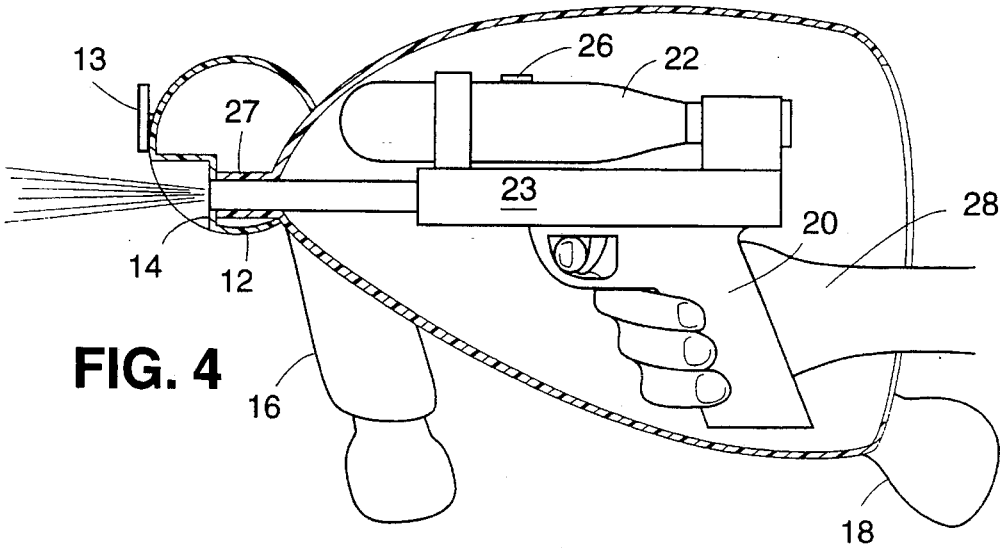
FIG. 4 shows the hand of a player gripping the water-pistol concealed in the puppet, the trigger being pulled to cause liquid to spirit out of the open mouth of the head of the puppet.

As shown in FIG. 4, when a player has his hand 28 inserted in the interior of the shroud and grasps hand grip 20 of the water-pistol, he then appears to be holding the puppet as a puppeteer would, for the water-pistol is concealed and an observer therefore sees only the hand-held puppet.

But when the player holding the puppet pulls trigger 21 of the water-pistol, this action activates pump 23 to draw liquid from reservoir 22 to pump this liquid through barrel 24 from whose outlet nozzle 25 the liquid is ejected. The ejected liquid is discharged from the open mouth of the puppet.

Hence the puppet then appears to an observer to be spitting out the liquid. While this perhaps represents a form of mischievous or anti-social behavior, puppets traditionally are not well behaved which is why puppet shows delight children.

Thus when a child holds in his hand a water-pistol and puppet assembly in accordance with the invention, he appears to be manipulating a conventional puppet, for the water-pistol is concealed and an observer has no idea as to the true nature of the assembly. It is only when the puppet spits out liquid and sprays the observer with the liquid that the observer becomes aware that there is more to the puppet than meets the eye.

In practice, a family of different puppet assemblies may be provided so that each child is given a particular character. Thus five children each holding a different character, can play a game in which each child seeks to spray another child. When a child is made wet by another child he is out of the game, and the winner is the surviving child who remains dry.

In practice, the liquid stored in each of the several pistols involved in the game may be contain a dye of a distinctive color, the liquid being water-soluble and innocuous, so that it may be easily washed off. In this way when in this game a child is made wet by the dyed liquid, the child responsible for this action is easily identified.

The invention is not limited to any particular form of water-pistol, for any commercially available water-pistol may be incorporated into the assembly as long as its dimensions can be accommodated in the shroud of the associated puppet.

Use may be made of battery-powered water-pistols having a motor-driven pump which is switched on only when the trigger is pulled. And when use is made of a battery-powered water pistol, the pistol may include a microelectronic sound chip which when the trigger is pulled, reproduces recorded sounds appropriate to the character represented by the puppet. This chip may be embedded in the foam plastic head of the puppet so that the sound emanates from the head.

Thus if the puppet resembles say the Cookie Monster, Sesame Street character, the voice issuing from the puppet when the trigger is pulled can be the familiar voice of this character. Or if the puppet resembles a dog, when the trigger is pulled the puppet will then bark. And one may install LED's in the eye sockets of the puppet which light up each time the trigger is pulled.

Figure 5:
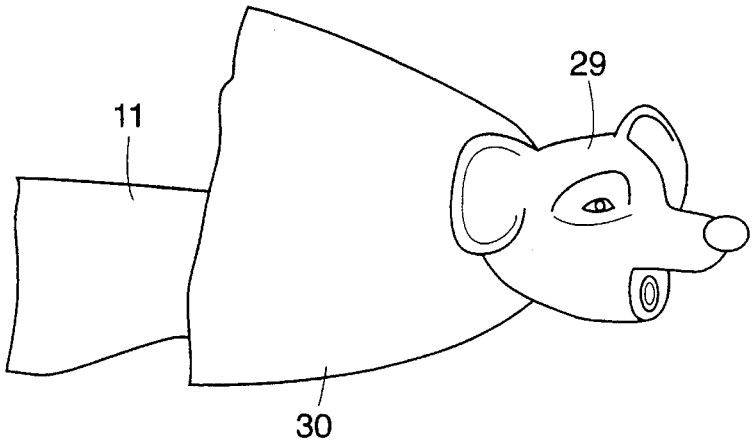
FIG. 5 shows an assembly in which the puppet has an animal-like head.

The invention is not limited to puppets having humanoid forms, for as shown in FIG. 5, the head 29 of the puppet to which a shroud 30 is attached may be in an animal-like form such as that of a dog, in which case the shroud is provided with appendages simulating the forelegs and rear legs of the dog. Since it is only the head of the puppet which supports the pistol within the shroud, it must have sufficient structural strength for this purpose.

While there has been shown preferred embodiments of the a water pistol and puppet assembly, it will be appreciated that many changes may be made thereon without departing from the spirit of the invention.

Thus it is not essential to the invention that water from the nozzle of the pistol be ejected through an open mouth in the head of the puppet. The arrangement may be such as to cause the water to be emitted from an opening in the puppet.

I claim:

1. A water-pistol and puppet assembly comprising:

A. a puppet having a head provided with an open mouth, an internal cavity communicating with the mouth and a costume shroud having an open top end defining a neck attached to the head in registration with the cavity, said shroud having an open bottom giving access to an interior of the shroud; and B. a water-pistol concealed within the interior of the shroud, said pistol having a barrel which is socketed in the cavity of the head and is provided with an outlet nozzle in alignment with the open mouth, said pistol having a hand grip provided with a trigger, whereby when a hand of a player is inserted through said open bottom of the shroud to grasp the hand grip, the puppet is then held by this hand, and when the player pulls the trigger with a finger of said hand, liquid is then ejected from the nozzle and the open discharged from the open mouth in alignment with the nozzle to stimulate a spitting action.

2. An assembly as set forth in claim 1, in which the head cavity is lined by a cylindrical sleeve which sockets the barrel of the pistol.

3. An assembly as set forth in claim 1, in which the pistol is provided with a liquid reservoir and a pump which when the trigger is pulled then draws water from the reservoir and pumps it into the barrel.

4. An assembly as set forth in claim 1, in which the head is that of a humanoid figure and the shroud is provided with arm and leg extensions to simulate the figure.

5. An assembly as set forth in claim 1, in which the head simulates the head of a four-legged animal and the shroud is provided with four leg extension to simulate animal.

6. An assembly as set forth in claim 1, in which the shroud is formed of fabric material.

7. An assembly as set forth in claim 1, in which the shroud is formed of plastic film material.

* * * * *

UNITED STATES PATENT AND TRADEMARK OFFICE

CERTIFICATE OF CORRECTION

PATENT NO. : 5,564,961

DATED : October 15, 1996

INVENTOR(S) : Donald Spector

It is certified that error appears in the above-identified patent and that said Letters Patent is hereby corrected as shown below:

Column 5, line 1, delete "the open" after "and".

Signed and Sealed this

Thirty-first Day of December, 1996

*Attest:*

*Attesting Officer*

BRUCE LEHMAN

*Commissioner of Patents and Trademarks*